US010464343B2

(12) United States Patent
Van Garsse

(10) Patent No.: US 10,464,343 B2
(45) Date of Patent: Nov. 5, 2019

(54) INKJET PRINTING METHOD FOR DECORATIVE IMAGES

(71) Applicant: AGFA NV, Mortsel (BE)

(72) Inventor: Joris Van Garsse, Mortsel (BE)

(73) Assignee: AGFA NV, Mortsel (BE)

( * ) Notice: Subject to any disclaimer, the term of this patent is extended or adjusted under 35 U.S.C. 154(b) by 9 days.

(21) Appl. No.: 15/541,493

(22) PCT Filed: Jan. 8, 2016

(86) PCT No.: PCT/EP2016/050257

§ 371 (c)(1),
(2) Date: Jul. 5, 2017

(87) PCT Pub. No.: WO2016/113190

PCT Pub. Date: Jul. 21, 2016

(65) Prior Publication Data

US 2017/0348978 A1 Dec. 7, 2017

(30) Foreign Application Priority Data

Jan. 12, 2015 (EP) ..... 15150774

(51) Int. Cl.

| | |
|---|---|
| ***B41J 2/21*** | (2006.01) |
| ***B41M 5/00*** | (2006.01) |
| ***B44C 5/04*** | (2006.01) |
| ***B41J 2/165*** | (2006.01) |

(52) U.S. Cl.

CPC ..... *B41J 2/2135* (2013.01); *B41J 2/2146* (2013.01); *B41M 5/00* (2013.01); *B41M 5/0047* (2013.01); *B41J 2002/16529* (2013.01); *B44C 5/04* (2013.01)

(58) Field of Classification Search

CPC .... B41J 2/2132; B41J 2/04505; B41J 2/2135; B41J 2/2146; B41M 5/0047; B44C 5/04

USPC ..... 347/14, 19, 40

See application file for complete search history.

(56) References Cited

U.S. PATENT DOCUMENTS

| | | | | |
|---|---|---|---|---|
| 2005/0122358 | A1* | 6/2005 | Mitsuzawa | B41J 2/2128 347/14 |
| 2010/0309526 | A1 | 12/2010 | Kulkarni et al. | |
| 2013/0295352 | A1 | 11/2013 | Thiers et al. | |
| 2013/0321512 | A1 | 12/2013 | Chen et al. | |
| 2014/0118762 | A1 | 5/2014 | Nakura et al. | |

OTHER PUBLICATIONS

Official Communication issued in International Patent Application No. PCT/EP2016/050257, dated May 9, 2016.

* cited by examiner

*Primary Examiner* — Jannelle M Lebron

(74) *Attorney, Agent, or Firm* — Keating and Bennett, LLP

(57) ABSTRACT

An inkjet printing method, performed by an industrial inkjet system to form a decoration layer, includes the steps of printing copies of a decorative image with a printing unit on a substrate by transmitting consecutive bitmap rows of the decorative image to a printing unit, measuring dimensional changes in the substrate while printing copies of the decorative image, and compensating the dimensional changes while printing copies of the decorative image by one of: skipping at least one bitmap row of the decorative image upon dimensional expansion, or reprinting at least one bitmap row of the decorative image on the substrate upon dimensional shrink.

11 Claims, 2 Drawing Sheets

INKJET PRINTING METHOD FOR DECORATIVE IMAGES

CROSS REFERENCE TO RELATED APPLICATIONS

This application is a 371 National Stage Application of PCT/EP2016/050257, filed Jan. 8, 2016. This application claims the benefit of European Application No. 15150774.6, filed Jan. 12, 2015, which is incorporated by reference herein in its entirety.

BACKGROUND OF THE INVENTION

1. Field of the Invention

The present invention relates to a compensation of dimensional changes in a substrate during an inkjet printing method for decorative images as part of a manufacturing method of decorative workpieces.

2. Description of the Related Art

Gravure, offset and flexography are being increasingly replaced for different applications by industrial inkjet printing systems, which have now proven their flexibility in use, such as variable data printing making short production runs and personalized products possible, and their enhanced reliability, allowing incorporation into production lines.

Inkjet technology has also caught the attention of manufacturers of decorative workpieces, such as laminate floor.

To attach a decorative image on a decorative surface, a substrate is printed with the decorative image, which is traditionally performed by means of rotary printing such as gravure, to form a decoration layer. The decorative image determines the appearance of the decorative side of the final product: a decorative workpiece, such as kitchen panels, flooring panels, furniture panels, ceiling panels, wall panels, fire resistant panels, wall cladding panels, cubicle wall panels and floor panels.

Inkjet technology has also caught the attention of manufacturers of decorative workpieces, such as laminate floor. An example of inkjet technology for manufacturing decorative workpieces is disclosed in JUPITER Digital Printing Line™ from Hymmen™ (www.hymmen.com).

Several methods, such as direct pressure laminate (DPL) or high pressure laminate (HPL), are known to manufacture a decorative workpiece but in general manufacturing a decorative workpiece comprises the following steps:

a) a set of extra layers up and/or under the decoration layer are applied; and b) heat pressing all these layers with a heated press. The decorative workpieces are rigid panels or flexible panels whether or not on roll. A layer from the set of extra layers may comprise also a printed image such as a background image.

An extra known step c) for the manufacturing of decorative workpiece is forming a relief in the surface of the decorative workpiece, more particularly in the form of impressions, to imitate, for example, the natural relief of wood, in the form of impressions representing the pores, grooves and the like, in accordance with the printed decorative image. Normally, the impressions are formed by making use of a press plate provided with a relief while heat pressing. The press plate has to be aligned according the printed decorative image with a minimum of deviations over the entire surface of the decorative workpiece.

While printing and after printing the decorative image on a substrate, the dimensions of the substrate may changed due to the manipulation of the substrate until a decorative workpiece. For example in DPL- and HPL-manufacturing, the substrate is a paper which is impregnated, or at least a portion thereof, with a resin in liquid condition before applying the set of extra layers up and/or under the decoration layer in step a). The dimensions of the wet decoration layer become unstable and the decoration layer is sensitive for dimensional expansion and/or shrinkage, due to the wet fibres in the paper.

Another example of dimensional changes of the substrate may occur when the substrate is provided on roll wherein the substrate while and after printing is kept flat by applying forces and/or unwinding the substrate. The dimensions of the decoration layer may deform by the applied force for unwinding and/or keeping flat of the substrate. Especially in post-printing methods, such as cutting and impregnating the decoration layer, the applied forces may vary which deform the decoration layer not with a determinable dimensional change.

In the manufacturing of decorative workpieces, many steps in the process may cause dimensional changes in the decoration layer such as heating up of the substrate, decoration layer, curing of the jetted ink, applying one of the extra layers of step a) mechanically or chemically, priming the decoration layer with a liquid, heat pressing the layers of step a) . . . .

The dimensional changes of the substrate and the decoration layer may cause deviations of colour-on-colour register, layer-on-layer image register, deviations in the aligning of the relief and the decorative image or register difficulties while cutting on the edges of the decorative image to decorative panels.

The dimensional changes of the substrate are subject to parameters of the manufacturing process, such as impregnation speed, humidity and temperature, and dimensional changes are subject to variances meanwhile the manufacturing process. To avoid waste of costly decoration layers, the compensation and the variance of these dimensional changes have to be fast. So a method to compensate the dimensional changes of the substrate in the manufacturing of decorative workpieces is needed and this preferably without interruption or slow down of the manufacturing process.

US2013295352 (FLOORING INDUSTRIES) discloses a problem of dimensional changes wherein the problem is solved at [0102-0110] by scaling width-wise the whole decorative image, before printing the whole scaled decorative image on a digital printer. This solution acquires a lot a computing capacity and huge amount of image buffering memory for the image prior scaling and after scaling which is economically not feasible for manufacturing decorative panels.

US20130321512 (SAMUEL CHEN) discloses, however in the field of commercial inkjet printing systems, a stretch/shrink detection system in print media while printing, for example magazines, wherein the problem is solved at [0071] by modifying the timings of ejecting ink drops or changing the speed of print media. This solution can causes errors in color-on-color registration.

US20100309526 (RAKESH KULKARNI) discloses for sheet-based xerographic document printing systems a solution for shrink/enlargement caused by a fuser in the system.

SUMMARY OF THE INVENTION

In order to overcome the problems described above, preferred embodiments of the present invention have been realised with an inkjet printing method for printing decorative images as defined below.

It is found that using a digital printing method for decorative images such as an inkjet printing method, the possibilities to make adaptations at the latest (milli)second before printing a copy of a decorative image on a substrate. By dividing such decorative image in bitmap rows which are than transmitted by a data-streamer (200) to a printing unit, the decision to adapt, to skip, to reprint, to print consecutive bitmap rows closer or further to each other may be controlled in the data-streamer (200) to solve the problems described above. In traditionally printing methods, such as gravure, to form a decoration layer, this late adaptations and decisions on-the-fly are not feasible. Also these late adaptations and decisions of the present invention have an economical benefit because waste of substrate, decoration layer may be avoided if the dimensions of the substrate are changed meanwhile the inkjet printing method and/or manufacturing method of decorative workpieces.

Probably the reason of skipping, reprinting, closer and further printing, without disturbing print quality issues in the decoration layer, is the high similarity between two consecutive bitmap rows in decorative images, which is in the nature of such images. The similarity of consecutive bitmap rows may be a pixel-base image similarity or a histogram-based image similarity or a texture similarity or shape similarity.

For clarification, it is known that a decorative image is printed on one side of a substrate to determine the appearance of the decorative side of a final product: a decorative workpiece: such as kitchen panels, ceiling panels, wall panels; fire resistant panels, wall cladding panels, cubicle wall panels and floor panels. So the present invention is a simplex inkjet printing method and not a duplex inkjet printing method.

Further advantages and embodiments of the present invention will become apparent from the following description.

DETAILED DESCRIPTION OF THE PREFERRED EMBODIMENTS

Figure 1:
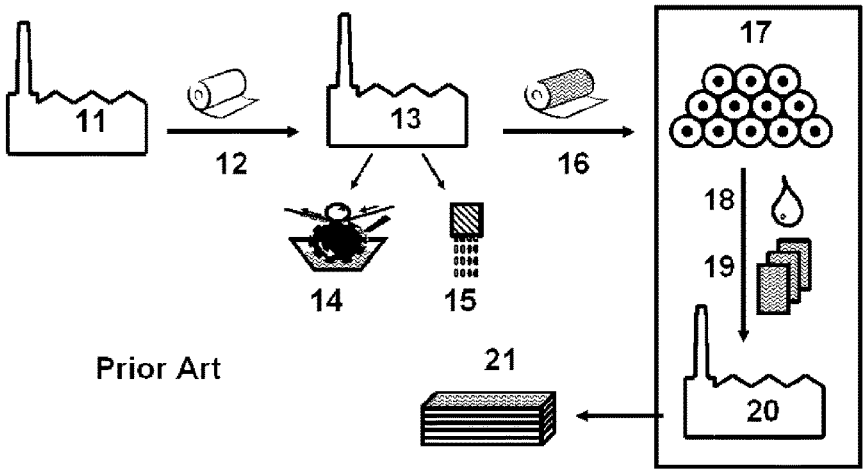
FIG. 1 shows the prior art production process for manufacturing decorative panels, wherein a paper manufacturer (11) supplies a paper roll (12) to a decor printer (13) using gravure printing (14) or inkjet printing (15) in order to deliver a decor paper roll (16) to a warehouse (17) of a floor laminate manufacturer (20). Depending on the market demand, the floor laminate manufacturer (20) selects one of the different decor rolls in his warehouse (17) to impregnate (18) and to cut to a size (19) for being heat pressed and finished into ready-to-use floor laminate (21).
Figure 2:
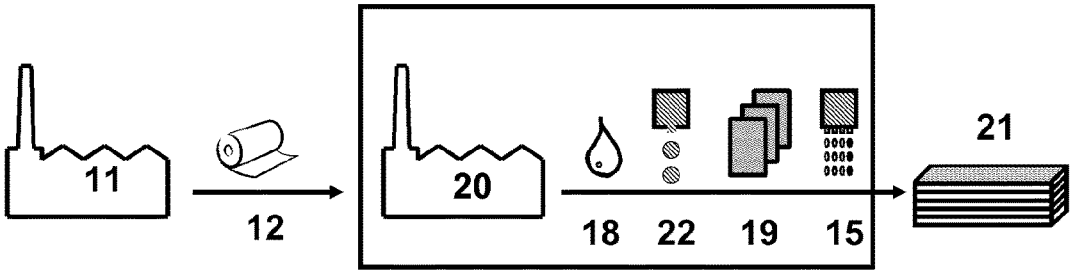
FIG. 2 shows a production process for manufacturing decorative panels, wherein a paper manufacturer (11) supplies a paper roll (12) directly to a floor laminate manufacturer (20) who impregnates (18) the paper roll (12), prints an ink acceptance layer (22) on the paper, cuts to a size (19) for being inkjet printed (15) and then heat pressed and finished into ready-to-use floor laminate (21). The order of cutting to size (19) and inkjet printing (15) may also be reversed, i.e. printing on a impregnated paper roll before cutting to sheets.
Figure 3:
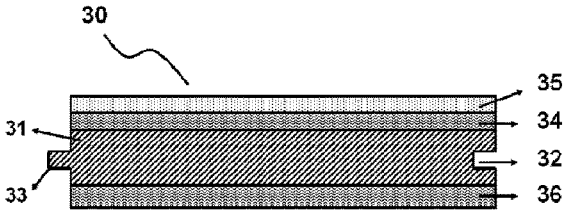
FIG. 3 shows a cross-section of a decorative panel (30) including a core layer (31) with a groove (32) and tongue (33) which is laminated on the top side by a decorative layer (34) and a protective layer (35) and on the back side by a balancing layer (36).
Figure 4:
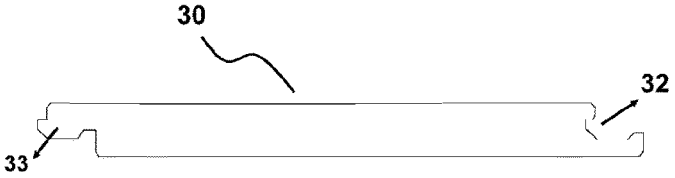
FIG. 4 shows a cross section of a decorative panel (30) having a tongue (33) and a groove (32) for a mechanical joint which requires no glue.

The present invention includes an inkjet printing method, performed by an industrial inkjet system to form a decoration layer, comprising the steps of: printing copies of a decorative image with a printing unit on a substrate by transmitting consecutive bitmap rows of the decorative image to a printing unit; measuring dimensional changes in the substrate while printing copies of the decorative image; and compensating the dimensional changes while printing copies of the decorative image by one of: skipping at least one bitmap row of the decorative image and/or printing two consecutive transmitted bitmap rows with a row print distance smaller than a nominal row print distance (400) upon dimensional expansion; or reprinting at least one bitmap row of the decorative image on the substrate and/or printing two consecutive transmitted bitmap rows with a row print distance larger than the nominal row print distance (400) upon dimensional shrink.

In a decorative image, such as decorative image which represents wood, it is found that similarity, for example of tone-values, between consecutive bitmap rows is high due do the patterned nature of decorative images. The skipping of a bitmap row shall therefore minimal influence the print quality that hardly can be seen on the decoration layer or decorative workpiece by the naked eye. Also the reprint of a bitmap row shall therefore minimal influence the print quality that hardly can be seen on the decoration layer or decorative workpiece by the naked eye. Skipping or reprinting a bitmap row results in a dimensional change in one direction of the decoration layer, which may be used to compensate dimensional changes in the substrate, for example when the substrate with the decoration layer is impregnated by a liquid. Another example the dimensional changes in a decoration layer may become unstable such as more stretchable, due to curing and/or heating the substrate and/or decoration layer. If a reprint of a bitmap row is still annoying than in a preferred embodiment the tone values of a to-be-reprinted bitmap row is adapted slightly on its tone values before printing to avoid the annoying visual doubling of a bitmap row. The adaption is preferably performed by one or more GPU's which is disclosed to the industrial inkjet system or data-stream. Such small adaption is, due the high similarity, for example in tone-values, between consecutive bitmap rows, not noticeable for the naked eye but guarantees annoying visual doubling of a bitmap row. These small adaptations may comprise:

one or more pixel shifts, preferable less than 10 pixels, more preferably less than 5 pixels and/or a gamma correction, as known in the field of image manipulation, wherein gamma preferably between 1.2 and 0.8, and more preferably between 1.1 and 0.9.

A small adaption is defined by the following constraint:

Math. 1

$$f(R, R_{adapt}) = \frac{\sum_{i=1}^{n} |c(R[i]) - c(R_{adapt}[i])|}{n * c(\mathrm{MAX}(R))} \leq 0.05$$

R is the discrete image of the to-be-reprinted bitmap row with image size nxl; and $R_{adapt}$ is the discrete image of the small adapted to-be-reprinted bitmap row with image size nxl; and the function c( ) is an image characteristic that assigns a number to each image pixel of a discrete image. An example of function c( ) is obtaining a gray value of the pixel.MAX( ) is a function to obtain the maximum value of a bitmap row.

It is found that the minimal effect in print quality by skipping and reprinting, while not adapting the to-be-reprinted bitmap row, shall become unnoticeable when the print resolution is above 300 dots per inch (DPI).

To refine the compensation of dimensional changes, the embodiment of the present invention comprises also a step wherein the row print distance between printed transmitted consecutive bitmap rows is controlled. By printing two consecutive transmitted bitmap rows closer to each other, the decoration layer shall dimensional change in one direction, namely become shortened. And by printing two consecutive transmitted bitmap rows further away from each other, the decoration layer shall dimensional change in one direction, namely become enlarged. This shrinking or enlarging may be used to compensate dimensional changes in the substrate, for example when the substrate with the decoration layer is impregnated by a liquid.

In an industrial inkjet system, the movement of the substrate underneath the printing unit, may be measured by an encoder signal, reproduced by an encoder. This movement, for example by a linear motor, and a printing unit, with its comprised print-head, are controlled by a specific program and separate electronic circuits in the printing unit. The synchronization between the linear motor and the print-head is possible because the encoder pulses of the linear motor are also fed to the electronic circuits that controlled the print-head. The firing pulses of the print head is supplied synchronously with the encoder pulses of the linear motor and thus in this manner the movement of the substrate is synchronized with the inkjet print head. The synchronizing is determined by the resolution of the decorative image across its bitmap rows, which also determines the nominal print distance between printed consecutive bitmap rows. If the resolution of the encoder pulses is higher than the fire frequency of the printing head, the synchronizing between encoder pulses and the firing pulses may be adapted to make the refinement of this preferred embodiment achievable.

In a preferred embodiment the step of printing two consecutive transmitted bitmap rows with a row print distance smaller than the nominal print distance wherein difference between the nominal row print distance (400) and twenty percent of the nominal print distances is larger than the row print distance, more preferably wherein difference between the nominal row print distance (400) and seventeen percent of the nominal print distances is larger than the row print distance. This preferred embodiment has the advantage that no overlapped printed lines in the decoration layer can be noticed; else it can affect worse the print quality of the decoration layer.

In a preferred embodiment the step of printing two consecutive transmitted bitmap rows with a row print distance larger than the nominal print distance wherein sum of the nominal row print distance (400) and twenty percent of the nominal print distances is larger than the row print distance, more preferably wherein sum of the nominal row print distance (400) and seventeen percent of the nominal print distance is larger than the row print distance. This preferred embodiment has the advantage that no unprinted lines in the decoration layer can be noticed; else it can affect worse the print quality of the decoration layer.

In the manufacturing process of decorative workpieces, several steps, such as impregnating, adding overlay or heat-pressing with extra layers, may also devisualize the minimal effects of skipping, reprinting, smaller and larger row print distance versus the nominal row print distance (400), so the present invention is an advantage for the manufacturing of decorative workpieces.

In a preferred embodiment a decorative image is analysed, especially bitmap row by bitmap row, to determine if a bitmap row is skippable and/or reprintable. It is known that the similarity of consecutive bitmap rows in a decorative image is high but in some cases the similarity drops for consecutive bitmap rows to a lower similarity for example at the occurrence of a knot and/or crack, as wood grain imperfection, in a decorative image representing wood. The image analysis may comprise fast Fourier transformations (FFT), histogram calculations and filtering methods. And the image analysis is preferably performed by one or more GPU's. To compensate dimensional changes in this preferred embodiment, transmitted bitmap rows of the decorative image are checked if they are after all be skippable and/or reprintable. If they are not skippable or reprintable, another bitmap row is selected.

Another example why bitmap rows may be determined to be unskippable or non-reprintable is that part of a track-and-trace code, visible or not visible, is part of a bitmap row. If the bitmap should be skipped or reprinted, then there is a possibility that the track-and-trace code cannot be read anymore.

The measurement of the dimensional changes is preferably done there were such dimensional changes may occur so the compensation in the transmittance of the bitmap rows can be handled fast and correct. The measurement of the dimensional changes may be performed after:

drying the decoration layer with a dryer; and/or cutting the decoration layer with a cutting device; and/or priming the decoration layer with a liquid; and/or supplying another layer on top or on the bottom of the decoration layer by an adhesive; and/or impregnating the decoration layer with a liquid.

The measurements are preferably compared with measurements of dimensional changes of a substrate before:

drying the decoration layer with a dryer; and/or cutting the decoration layer with a cutting device; and/or priming the decoration layer with a liquid; and/or supplying another layer on top or on the bottom of the decoration layer by an adhesive; and/or impregnating the decoration layer with a liquid.

The drying, curing, priming, priming, supplying and impregnating are preferably performed by the industrial inkjet system which performs the printing of the decorative image on the substrate. Especially in a more preferred embodiment the measurement is performed after impregnating with a liquid and in most preferred embodiment the liquid is a thermosetting resin, which may comprise or which may be a melamine-formaldehyde based resin, ureum-formaldehyde based resin and/or phenol-formaldehyde based resin.

Preferably the decorative image represents wood and the wood grains in this decorative image are oriented perpendicular to the bitmap rows of the decorative image. The similarity, for example of tone-values, in consecutive bitmap rows from such decorative image is very high due to the patterned nature of such decorative images. If the wood grains are oriented parallel to the bitmap rows than the similarity of consecutive bitmap rows is less than in the preferred embodiment. Higher the similarity of consecutive bitmap rows, lower the effect in print quality when performing the inkjet printing method of the present invention.

It is found that the effect of skipping or doubling a print row on print quality is minimized as the nominal row print distance (400) between two printed consecutive transmitted bitmap rows is less than 85 μm and preferably less than 45 μm and more preferably less than 25 μm. In a preferred embodiment the nominal row print distance (400) is from 5 μm until 85 μm. A reason for this minimal effect is the similarity, for example in the tone values, of consecutive bitmap rows, especially when the nominal row print distance (400) is low.

In a preferred embodiment the inkjet printing method is a single pass inkjet printing method which is preferably performed by an industrial single pass inkjet printing system or preferably performed by an industrial multi pass inkjet printing system in a single pass inkjet printing mode. Printing a decoration layer in a single pass, gives a boost to the manufacturing time of decorative workpieces which is an economical advantage for a decorative workpiece manufacturer.

In another preferred embodiment, a transmitted bitmap row is halftoned before the bitmap row is send for jetting to a printing unit of an industrial inkjet printing system, preferably an industrial single pass inkjet system. The halftoning method is preferably a dithering method and more preferably an amplitude modulated halftoning method or a frequency modulated halftoning method. More detail about dithering methods is disclosed in ULICHNEY, ROBERT. Digital Halftoning. Edited by THE MIT PRESS. USA: Massachusetts Institute of Technology, 1987. ISBN 0262210096. This preferred embodiment is advantageous because skipping or reprinting bitmap rows containing already halftoned data disturbs the halftone forming in the printed decorative image which is not the case in this preferred embodiment.

Before the halftoning method from the previous preferred embodiment, a transmitted bitmap row is image manipulated to compensate ink volume variances, also called density variations, by nozzles from a printing unit and/or print-head of an industrial inkjet system. A nozzle in a printing unit or print-head may jet a different ink volume for the same tone-value in a bitmap row, this results density differences, such as dark or light bands, in the decoration layer which is not acceptable and a serious quality issue in the manufacturing of decorative workpieces. It is found that by enlarging or lowering a tone-value at a position in a bitmap row, an ink volume difference in a nozzle, which corresponds to this position, may be compensated.

Jetting a relief with a transparent ink on a decorative workpiece is a preferably comprised method of the manufacturing of a decorative workpiece. The relief may be jetted with several jetted layers of the transparent ink on top of each other to provide a three-dimensional relief on the decorative workpiece. The relief is to imitate, for example, the natural relief of wood, in the form of tactile elements representing the pores, grooves and the like, in accordance with the printed decorative image. These tactile elements, whether or not printed three-dimensional, has to be aligned according the printed decorative image with a minimum of deviations over the entire surface of the decorative workpiece. The present invention and its preferred embodiments controls the dimensional changes of the decoration layer so the match and alignment of the tactile elements and the decorative image has a minimum of deviation so the image, two-dimensional or three-dimensional image, that represents the relief that is jetted does not to been changed due to dimensional changes of the decoration layer. In a preferred embodiment the data-streamer (200) of the present invention also transmits an image that represents the relief, to a printing unit to jet a relief on a decorative workpiece. The transmittance is preferably row-by-row and for a three-dimensional image also layer-by-layer. The printing unit that jets the relief on the decorative workpiece may be comprised in the industrial inkjet system of the present invention.

Decorative Image

A decorative image is an image representing wood, stone, rock or fantasy pattern.

An advantage of an image representing wood is that a decorative workpiece, such as floor, can be manufactured imitating besides oak, pine and beech, also very expensive wood like black walnut which would normally not be available for house decoration and that it is easy replaceable over time according to fashion.

An advantage of an image representing stone is that a floor, as decorative workpiece, can be manufactured which is an exact imitation of a stone floor, but without the cold feeling when walking barefooted on it and that it is easy replaceable over time according to fashion.

A decorative image is achieved by suitable commercially available hardware, such as scanning a photograph or taking an image by a digital camera, and commercially available software, such as Adobe Photoshop™ to manipulate and create decorative images.

The size of a decorative image may have a width between 50 mm and 4000 mm and a length between 100 mm and 6000 mm.

A decorative image is preferable rectangular shaped but it can also be triangular, quadratic, rectangular, heptagonal, pentagonal and octagonal, or elliptical shaped. A decorative image may have a side with 1 or more curved parts. The advantage of rectangular shaped decorative image is the ease of cutting to a decorative workpiece, which may be a step of the embodiment. Rectangular or non-rectangular shaped decorative images may be cut by cutting plotters. The use of cutting plotters is more time-consuming but non-rectangular shaped decorative images expand the amount of assembling creations of decorative workpieces such as mosaic flooring with laminates, or design furniture.

The content of a decorative image is preferable defined in raster graphics format such as Portable Network Graphics (PNG), Tagged Image File Format (TIFF) with or without the BigTIFF File Format proposal of Joris Van Damme (www.awaresystems.be), Adobe Photoshop Document (PSD) or Joint Photographic Experts Group (JPEG) or bitmap (BMP) but more preferably in vector graphics format, wherein the decorative image as raster graphics format is embedded. Preferred vector graphics formats are Scale Vector Graphics (SVG) and AutoCad Drawing Exchange Format (DXF) and most preferably the decorative image is embedded in a page description language (PDL) such as Postscript (PS) or Portable Document Format (PDF).

A decorative image may be stored and/or loaded as one or more files on a memory of a computer. The embodiment may comprise a method to load a decorative image into a memory of a computer, for example to provide bitmap rows of the decorative image to the data-streamer (200).

A decorative image is presented by a plurality of bitmap rows and its know that the differences between consecutive bitmap rows of such decorative images are very small due to the repeatability's and patterning inside the decorative image such as wood grains.

A decorative image may be a continuous tone image (CT) or a raster image. A continuous tone image is an image wherein each position, also called pixel, may have a very large number of values to represent a tone and/or colour, such as a digital image captured by a digital camera. A raster image is the result of a halftoning method on a continuous tone image to make it printable on an industrial inkjet system so the raster image has the same spatial and tonal resolution as the industrial inkjet system. Each position in a raster image has a limited number of values to represent a tone and/or colour.

In a preferred embodiment the decorative image, each pixel for each colourant channel has a tone value from 0 to $(2^N-1)$ wherein N is preferably eight or more preferably sixteen.

The colourant space of a decorative image is preferably an RGB-space, such as the standard RGB colour space sRGB created cooperatively by HP and Microsoft in 1996 for use on monitors, printers and the Internet. To convert the decorative image to the colourant space of an industrial inkjet system, a preferred embodiment of the present invention may comprise a method to convert images from a first colourant space to a second colourant space by a colour management system and in a more preferred embodiment the image conversion between these two colourant space is achieved by a set of ICC-profiles, which is a set of data that characterizes a colour input and/or output device and/or a colour space, according to standards promulgated by the International Colour Consortium (ICC). The conversion from a colourant space to the colourant space of the industrial inkjet may be performed by a data-streamer (200) by converting bitmap row by bitmap row before printing the bitmap rows.

In a preferred embodiment of the present invention the decorative image is halftoned to a raster image by a halftone management system (210) with a dithering method such as an amplitude modulated (AM) halftoning method and a frequency modulated (FM) halftoning method or with an error diffusion (ED) halftoning method. A preferred halftoning method is halftoning the decorative image with a cross modulated (XM) halftoning method which achieves automatic, artefact-free, high resolution raster images. XM applies FM screening steps in the highlights and/or shadows to capture fine details and AM screening steps in the midtones to achieve smooth gradations. A cross modulated (XM) screening method is an example of a hybrid AM screening step.

The halftoning method in a halftone management system (210) and/or the colour conversion in a colour management system may be performed by one or more graphic processing units (GPU's) which preferably be comprised in the industrial inkjet system of the present invention. The use of GPU's enhances the calculation force to prepare fast bitmap rows for transmitting to a printing unit of the industrial inkjet system.

Decoration Layer

The decoration layer is a substrate that carries a decorative image in a decorative workpiece or the decoration layer carries two or more decorative images in a decorative workpiece.

The size of a decoration layer if it is a sheet may have a width between 50 mm and 4000 mm and a length between 100 mm and 6000 mm. If the decoration layer is a web that width may between 50 mm and 4000 mm.

The decorative image printed on the substrate to form a decoration layer may be printed by a digital printer, preferably an industrial inkjet system.

The decorative image may be printed on a substrate consisting of or essentially made of wood particleboard and most preferably be printed on a rigid sheet, flexible sheet or a flexible material, such as thermoplastic foil. Rigid sheets may be selected from hard board, PVC, carton, wood and wood with an ink receiver. The rigid sheets preferably have a thickness from 3 mm to 3 centimeters and more preferably have a thickness from 3 mm to 5 centimeters. Flexible sheet maybe selected from cellulose-based material, paper, impregnated paper, resin pre-impregnated paper, transparent foils, PVC sheets with thickness from 0.5 micrometer to 100 micrometers and preferably from 0.5 micrometer to 50 micrometers.

Flexible web material may be selected from cellulose-based material, paper, vinyl, fabrics, PVC or textile. Vinyl is an example of a thermoplastic foil.

The decoration layer, as flexible sheet or flexible web material, is preferably a printed paper with a weight from 50 to 150 g/m$^2$.

The decoration layer is preferably a thermoplastic foil and more preferably a thermoplastic foil between 60 μm and 300 μm. This preferred embodiment and more preferred embodiment are applicable to broadloom decorative workpieces, such as vinyl roll but also for decorative panels having a tongue and groove for glue-less interlocking with decorative panels having a similar tongue and groove. The decorative image is in both types of decorative workpieces in a preferred embodiment inkjet printed on transparent thermoplastic foil used as protective layer, the other thermoplastic foil, preferably opaque, is then fused to the side of the protective layer carrying the inkjet printed decprative image, more preferably together with a base layer (35) for enhancing the rigidness of the panel. In the latter the transparent thermoplastic foil fulfils the role of both the decorative layer as well as the protective layer, and may be called a decorative protective layer.

The advantage of having an opaque thermoplastic foil in contact with the protective layer is that the colour vividness of the inkjet printed image is enhanced and that any irregularities influencing image quality in a base layer are masked. The opaque thermoplastic foil is preferably a white opaque thermoplastic foil, but may also be a yellowish or brownish opaque thermoplastic foil for reducing ink consumption during inkjet printing.

In a more preferred embodiment a primer is applied on the second thermoplastic foil for further enhancement of the adhesion between the thermoplastic foils. The primer is preferably selected from a polyurethane hot melt primer, a polyamide hot melt primer, a vinylchloride vinylacetate primer (VC-VAC) or a two component system of aliphatic isocyanates and a hydroxyl-, carboxy- or amine functionalized polyester or polyether.

Decoration Paper

A decoration paper is a decoration layer wherein the substrate is paper which has a fibrous structure. It is also called deco paper or decor paper. In a preferred embodiment the decoration layer is a decoration paper.

The decoration paper preferably has a weight of less than 150 g/m$^2$, because heavier decoration paper is hard to impregnate all through their thickness with a thermosetting resin. Preferably said decoration paper has a paper weight, i.e. without taking into account the resin provided on it, of between 50 and 130 g/m$^2$ and preferably between 70 and 130 g/m$^2$. The weight of the paper cannot be too high, as then the amount of resin needed to sufficiently impregnate the paper would be too high, and reliably further processing the printed paper in a pressing operation becomes badly feasible.

Preferably, the decoration paper has a porosity according to Gurley's method (DIN 53120) of between 8 and 20 seconds. Such porosity allows even for a heavy sheet of more than 150 g/m$^2$ to be readily impregnated with a relatively high amount of resin.

Suitable decoration paper having high porosity and their manufacturing are also disclosed by US6709764 (ARJO WIGGINS).

The paper for the decoration layer is preferably a white paper and may include one or more whitening agents, such as titanium dioxide, calcium carbonate and the like. The presence of a whitening agent helps to mask differences in colour on the core layer which can cause undesired colour effects on the colour pattern.

Alternatively, the paper for the decoration layer may be a bulk coloured paper including one or more colour dyes and/or colour pigments. Besides the masking of differences in colour on the core layer, the use of a coloured decorative paper reduces the amount of inkjet ink required to print the colour pattern. For example, a light brown or grey paper may be used for printing a wood motif as colour pattern in order to reduce the amount of inkjet ink needed.

In a preferred embodiment, unbleached Kraft paper is used for a brownish coloured decoration paper in the decoration layer. A preferred type of Kraft paper is an absorbent Kraft paper of 40 to 135 g/m$^2$ having a high porosity and made from clean low kappa hardwood Kraft of good uniformity.

Resin Impregnation Method

In a preferred embodiment the decoration layer, which carries a decorative image, is provided with an amount of resin, more particularly is soaked in resin and/or is impregnated with resin, also called a resin impregnation method. In a preferred embodiment the resin impregnation method comprises an inkjet printing method to jet the resin on the decoration layer by a print-head. Impregnation is providing a liquid on a substrate and saturating the substrate with the liquid. The difference between impregnating and coating is that in a coating method the liquid is applied to the outside surface of the substrate and the liquid is not seeped into the core of the substrate as in an impregnation method.

This resin impregnation method is the preferred method in the embodiment of manufacturing of decorative workpieces wherein decorative workpieces are laminate panels, in the first place laminate floor panels, however, in the second place also laminate panels for other purposes, such as for furniture, partition walls and the like. The decorative workpieces manufactured with a resin impregnation method may also be profiles used in furniture's or skirting boards.

Preferably the resin is a thermosetting resin and more preferably the thermosetting resin is a melamine based resin, more particularly a melamine formaldehyde based resin with formaldehyde to melamine ratio of 1.4 to 2. Other thermosetting resins may be ureum-formaldehyde based resins and phenol-form aldehyde based resins.

The resin impregnation method may be comprised in a high pressure decorative workpiece method such as high pressure laminate method (HPL) or direct pressure workpiece method such as direct pressure laminate method (DPL). Direct pressure workpiece method is a method of fusing a surface, inner layers and backing layers in a single pressing operation to manufacture a workpiece or nested workpiece.

Examples of resin impregnation methods for decorative workpieces are disclosed in WO2009153680 (FLOORING INDUSTRIES).

During the resin impregnation method the liquid for impregnation may also comprising additives, such as colourants, surface active ingredients, biocides, antistatic agents, hard particles for wear resistance, elastomers, UV absorbers, organic solvents, acids, bases, and the like.

The advantage of adding a colourant to the mixture containing the thermosetting resin is that a single type of white paper can be used for manufacturing the decoration layer, thereby reducing the stock of paper for the decorative laminate manufacturer. The use of a coloured paper, as already described above, to reduce the amount of ink required for printing a wood motif, is here accomplished by the white paper being coloured by impregnation by a brownish thermosetting resin. The latter allows a better control of the amount of brown colour required for certain wood motifs. Antistatic agents may be used in thermosetting resin. However preferably antistatic agents, like NaCl and KCl, carbon particles and metal particles, are absent in the resin, because often they have undesired side effects such as a lower water resistance or a lower transparency. Other suitable antistatic agents are disclosed by EP 1567334 A (FLOORING IND).

A resin impregnator which performs a resin impregnation method is preferably attached to an industrial inkjet system wherein the digital printed substrate, to form a decoration layer, is resin impregnated inside the industrial inkjet system. This gives an advantage by manufacturing decorative workpieces by printing-on-demand and manufacturing-on-demand. Methods for impregnating for example a paper substrate with resin and resin impregnators are well-known in the art as exemplified by WO 2012126816 (VITS) and EP2643648 (VITS).

Overlay

In the manufacturing of a decorative workpiece with resin impregnation methods an overlay may be used to protect the decorative image and to improve the abrasion resistance of the decorative workpiece. In a preferred embodiment the decoration layer is at the same time the overlay in the manufacturing of the decorative workpiece and wherein the decorative image is printed, preferably mirrored printed, on the bottom of the overlay.

In a known manufacturing method of decorative workpieces the overlay is also printed with an image and registered with the decorative image on the decoration layer before heat-pressing the set of layers. With the present invention, one can make sure that a register between the image of the overlay and the decorative image with minimal deviation can be achieved.

Industrial Inkjet System

An industrial inkjet system is a marking device that is using one or more printing units wherein one or more print-heads are mounted. The print-heads jet inkjet ink on an ink receiver. A pattern that is marked by jetting of the industrial inkjet system on an ink receiver is preferably an image. The pattern may be achromatic or chromatic colour. Industrial inkjet system essentially means using inkjet technology as a printing or deposition process in manufacturing or on production lines in a large scale. An industrial inkjet system is a robust, reliable inkjet system.

The way to incorporate print-heads into an industrial inkjet system is well-known to the skilled person. More information about inkjet systems is disclosed in STEPHEN F. POND. Inkjet technology and Product development strategies. United States of America: Torrey Pines Research, 2000, ISBN 0970086008.

The industrial inkjet system may mark a broad range of ink receivers: sheet-shaped or web-shaped. An ink receiver may be folding carton, acrylic plates, glass, honeycomb board, corrugated board, foam, medium density fibreboard, solid board, rigid paper board, fluted core board, plastics, aluminium composite material, foam board, corrugated plastic, textile, thin aluminium, paper, rubber, adhesives, vinyl, veneer, varnish blankets, wood, flexographic plates, metal based plates, fibreglass, transparency foils, rugs, carpets or adhesive PVC sheets.

The industrial inkjet system may comprise a step belt conveyor which is a piece of mechanical handling equipment that carries an ink receiver by moving from a start location to an end location via a porous conveyor belt in successive distance movements, also called discrete step increments. The direction movement from the start location to the end location is called the printing direction or conveying direction. The porous conveyor belt is linked between a plurality of pulleys wherein the porous conveyor belt rotates around the plurality of pulleys. An example of a general belt conveyor system comprising a vacuum table to hold an ink receiver while printing and wherein the vacuum table comprises pneumatic cleaning devices is disclosed in US 20100271425 (XEROX CORPORATION).

An industrial inkjet system which prints by a single pass printing method is a preferred embodiment. Such industrial inkjet systems are called industrial single-pass inkjet systems, which can be performed by using page wide inkjet print-heads or a printing unit wherein multiple print-heads are staggered to cover the entire width of an ink receiver. In a single pass printing method the inkjet print-heads usually remain stationary and the substrate surface is transported once under the inkjet print-heads.

An industrial inkjet system may also comprise a printing unit, comprising one or more print-heads, which is designed for reciprocating back and forth across an ink receiver in a fast scan direction FS and for repositioning across the printing table in a slow scan direction SS perpendicular to the fast scan direction. Such industrial inkjet systems are called industrial multi-pass inkjet printing systems. Printing is done during the reciprocating operation of the printing unit in the fast scan direction. Optional repositioning of the printing unit is done in between reciprocating operations of the printing unit, in order to position the printing unit in line with a non-printed or only partially printed area of the printing medium. The repositioning of the printing unit is unnecessary in situations where the printing unit is equipped to print a full-width printing medium in a single fast scan operation. During the printing, the printing table and supported thereon the printing medium remains in a fixed position. A support frame guides and supports the printing unit during its reciprocating operation. A printing medium transport system may feed individual ink receivers into the industrial inkjet system along a sheet feeding direction that is substantially perpendicular to the fast scan direction of the printing unit.

Alternatively to using a sheet-based medium transport system, e.g. a gripper bar transport system known from automated flat bed screen printing presses, the digital printer may also be used with a web-based medium transport system. The printing medium transport may feed web media into the digital printer from a roll-off at the input end of the digital printer to a roll-on at the discharge end of the digital printer. Inside the digital printer the web is transported along the printing table that is used to support the printing medium during printing. In the particular case of a web-based medium transport with a printing medium feeding direction equal to the slow scan direction, the repositioning of the printing unit along the slow scan direction may be replaced by a repositioning of the web in the feeding direction. The printing unit then only reciprocates back and forth across the web in the fast scan direction. To have a high productivity an industrial inkjet system benefits with a large amount of print-heads to enhance colour gamut, print speed or print resolution.

In a preferred embodiment the inkjet printing method of the present invention is performed by an industrial inkjet system.

The inkjet printing method is in a preferred embodiment comprised in the manufacturing of decorative workpieces and preferably comprised in the manufacturing of laminates.

After applying inkjet ink on the substrate, the inkjet ink may be cured and/or solidified by a curing device.

An industrial inkjet system may comprise the following devices:

a dryer, such as a curing device, for drying the decoration layer; and/or a cutting device for cutting the decoration layer; and/or a priming station for priming the decoration layer with a liquid; and/or a varnishing station for varnishing the decoration layer with a liquid; and/or a coating station for coating the decoration layer with a liquid; and/or a supplier for supplying another layer on top or on the bottom of the decoration layer by an adhesive; and/or an impregnation device for impregnating the decoration layer with a liquid, such as a resin impregnator.

The priming station may comprise a flexo station or a printing unit to jet the primer on a substrate or an already primed substrate. The top of the substrate becomes wet which may make the dimensions of the decoration layer unstable, especially when the substrate of the decoration layer is a fiber-containing product such as paper. In a preferred embodiment the liquid to prime comprises silica particles and more preferably microporous silica particles to have a superior print quality. The priming structure of a substrate strongly influences ink setting speed and uniformity, which in turn affects the quality of the final image, such as colour saturation, optical density, colour gamut and image resolution. Silica, such as fumed silica, is one of the most important inorganic oxides used for high performance, microporous substrate. Because of its fine particle size and high levels of microporosity, silica is capable of absorbing high amounts of fluid.

The coating station may comprise a flexo station or a printing unit to jet the coating on a printed decorative image or decoration layer or already coated printed decorative image or already coated decoration layer. The top of the decorative image or decoration layer becomes wet which may make the dimensions of the decoration layer unstable, especially when the substrate of the decoration layer is a fiber-containing product such as paper. In a preferred embodiment the liquid to coat is a liquid that comprises a thermosetting resin and in a more preferred embodiment this liquid comprises a melamine-formaldehyde based resin, ureum-formaldehyde based resin and/or phenol-formaldehyde based resin. The adding of an extra layer added on top of the decoration layer by coating, strengthen the decoration layer. This is also beneficial in the manufacturing of stiff or rigid decorative workpieces. The coating station may be a varnishing station.

The dryer, such as a curing device, infra-red radiation (IR), near-infrared (NIR) or short-wavelength infrared (SWIR) device, may also make the decoration layer unstable for its dimension. The heating may make the decoration layer more flexible which may cause the decoration layer stretchable for example due to a keeping flat force on the decoration layer or to a force by unwinding the substrate.

Print-Head

A print-head is a means for jetting an inkjet ink on an ink receiver through a nozzle. The nozzle may be comprised in a nozzle plate (600) which is attached to the print-head. A set of ink channels, comprised in the print-head, corresponds to a nozzle of the print-head which means that the inkjet ink in the set of ink channels can leave the corresponding nozzle in the jetting method. The inkjet ink is preferably an UV curable inkjet ink or water based inkjet ink, such as a water based resin inkjet ink.

The way to incorporate print-heads into a printing unit of an industrial inkjet system is well-known to the skilled person. A print-head is comprised in a printing unit. A printing unit comprises one or more print-heads which may print all the same colour or a set of colours such as cyan, magenta, yellow and black. A printing unit may comprise a print-head that jets a primer, varnish, transparent ink, semi-transparent ink, white ink, an ink comprising metallic particles, an ink comprising inorganic particles or an ink comprising thermosetting resin. A printing unit may comprise different types of print-heads for example a valve-jet print-head, to jet for example the primer, together with a piezoelectric print-head to jet for example the decorative image.

A print-head may be any type of print-head such as a valvejet print-head, piezoelectric print-head, thermal print-head, a continuous print-head type, electrostatic drop on demand print-head type or acoustic drop on demand print-head type or a page-wide print-head array, also called a page-wide inkjet array.

A print-head comprises a set of master inlets to provide the print-head with an inkjet ink from a set of external inkjet ink feeding units. Preferably the print-head comprises a set of master outlets to perform a recirculation of the inkjet ink through the print-head. The recirculation may be done before the droplet forming means but it is more preferred that the recirculation is done in the print-head itself, so called through-flow print-heads. The continuous flow of the inkjet ink in a through-flow print-heads removes air bubbles and agglomerated particles from the ink channels of the print-head, thereby avoiding blocked nozzles that prevent jetting of the inkjet ink. The continuous flow prevents sedimentation and ensures a consistent jetting temperature and jetting viscosity. It also facilitates auto-recovery of blocked nozzles which minimizes inkjet ink and ink receiver wastage. The recirculation of an inkjet ink results also in less inertia of the inkjet ink. In a more preferred embodiment the print-head is a through-flow piezoelectric print-head or through-flow valvejet print-head, wherein the high viscosity inkjet ink is recirculated in a continuous flow through an inkjet ink transport channel where the pressure to the inkjet ink is applied by a droplet forming means and wherein the inkjet ink transport channel is in contact with the nozzle plate. In a most preferred embodiment the droplet forming means in these print-heads applies a pressure in the same direction as the jetting directions towards the ink receiver to activate a straight flow of pressurized inkjet ink to enter the nozzle that corresponds to the droplet forming means. The advantage of such through-flow print-heads is a better dot-placement on an ink receiver than the non through-flow print-heads for example by less sedimentation in the print-head.

The number of master inlets in the set of master inlets is preferably from 1 to 12 master inlets, more preferably from 1 to 6 master inlets and most preferably from 1 to 4 master inlets. The set of ink channels that corresponds to the nozzle are replenished via one or more master inlets of the set of master inlets.

The amount of master outlets in the set of master outlets in a through-flow print-head is preferably from 1 to 12 master outlets, more preferably from 1 to 6 master outlets and most preferably from 1 to 4 master outlets.

In a preferred embodiment prior to the replenishing of a set of ink channels, a set of inkjet inks is mixed to a jettable inkjet ink that replenishes the set of ink channels. The mixing to a jettable inkjet ink is preferably performed by a mixing means, also called a mixer, preferably comprised in the print-head wherein the mixing means is attached to the set of master inlets and the set of ink channels. The mixing means may comprise a stirring device in an inkjet ink container, such as a manifold in the print-head, wherein the set of inkjet inks are mixed by a mixer. The mixing to a jettable inkjet ink also means the dilution of inkjet inks to a jettable inkjet ink. The late mixing of a set of inkjet inks for jettable inkjet ink has the benefit that sedimentation can be avoided for jettable inkjet inks of limited dispersion stability.

The inkjet ink leaves the ink channels by a droplet forming means, through the nozzle that corresponds to the ink channels. The droplet forming means are comprised in the print-head. The droplet forming means are activating the ink channels to move the inkjet ink out the print-head through the nozzle that corresponds to the ink channels.

The amount of ink channels in the set of ink channels that corresponds to a nozzle is preferably from 1 to 12, more preferably from 1 to 6 and most preferably from 1 to 4 ink channels.

The print-head of the present invention is suitable for jetting an inkjet ink having a jetting viscosity of 5 mPa·s to 3000 mPa·s. A preferred print-head is suitable for jetting an inkjet ink having a jetting viscosity of 20 mPa·s to 200 mPa·s.

In a preferred embodiment a resin impregnation method may use a print-head, such as a valvejet or piezoelectric print-head, to jet the resin on the decoration layer as resin impregnation method.

Valvejet Print-Head

A preferred print-head for the present invention is a so-called Valvejet print-head. Preferred valvejet print-heads have a nozzle diameter between 45 and 600 μm. The valvejet print-heads comprising a plurality of micro valves, allow for a resolution of 15 to 150 Dots-Per-Inch (DPI) that is preferred for having high productivity while not comprising image quality. A Valvejet print-head is also called coil package of micro valves or a dispensing module of micro valves. The way to incorporate valvejet print-heads into an inkjet printing device is well-known to the skilled person. For example, US 2012105522 (MATTHEWS RESOURCES INC) discloses a valvejet printer including a solenoid coil and a plunger rod having a magnetically susceptible shank. Suitable commercial valvejet print-heads are chromoJET™ 200, 400 and 800 from Zimmer, Printos™ P16 from VideoJet and the coil packages of micro valve SMLD 300's from Fritz Gyger™. A nozzle plate (600) of a Valvejet print-head is often called a faceplate and is preferably made from stainless steel.

The droplet forming means of a Valvejet print-head controls each micro valve in the Valvejet print-head by actuating electromagnetically to close or to open the micro valve so that the medium flows through the ink channel. Valvejet print-heads preferably have a maximum dispensing frequency up to 3000 Hz.

In a preferred embodiment the Valvejet print-head the minimum drop size of one single droplet, also called minimal dispensing volume, is from 1 nL (=nanoliter) to 500 μL (=microliter), in a more preferred embodiment the minimum drop size is from 10 nL to 50 μL, in a most preferred embodiment the minimum drop size is from 10 nL to 300 μL. By using multiple single droplets, higher drop sizes may be achieved.

In a preferred embodiment the Valvejet print-head has a native print resolution from 10 DPI to 300 DPI, in a more preferred embodiment the Valvejet print-head has a native print resolution from 20 DPI to 200 DPI and in a most preferred embodiment the Valvejet print-head has a native print resolution from 50 DPI to 200 DPI.

In a preferred embodiment with the Valvejet print-head the jetting viscosity is from 5 mPa·s to 3000 mPa·s more preferably from 25 mPa·s to 1000 mPa·s and most preferably from 30 mPa·s to 500 mPa·s.

In a preferred embodiment with the Valvejet print-head the jetting temperature is from 10° C. to 100° C. more preferably from 20° C. to 60° C. and most preferably from 25° C. to 50° C.

Piezoelectric Print-Heads

Another preferred print-head of the embodiment is a piezoelectric print-head. Piezoelectric print-head, also called piezoelectric inkjet print-head, is based on the movement of a piezoelectric ceramic transducer, comprised in the print-head, when a voltage is applied thereto. The application of a voltage changes the shape of the piezoelectric ceramic transducer to create a void in an ink channel, which is then filled with inkjet ink. When the voltage is again removed, the ceramic expands to its original shape, ejecting a droplet of inkjet ink from the ink channel.

The droplet forming means of a piezoelectric print-head controls a set of piezoelectric ceramic transducers to apply a voltage to change the shape of a piezoelectric ceramic transducer. The droplet forming means may be a squeeze mode actuator, a bend mode actuator, a push mode actuator or a shear mode actuator or another type of piezoelectric actuator. Suitable commercial piezoelectric print-heads are TOSHIBA TEC™ CK1 and CK1L from TOSHIBA TEC™ (https://www.toshibatec.co.jp/en/products/industrial/inkjet/prod ucts/cfl/) and XAAR™ 1002 from XAAR™ (http://www.xaar.com/en/products/xaar-1002).

An ink channel in a piezoelectric print-head is also called a pressure chamber.

Between an ink channel and a master inlet of the piezoelectric print-heads, there is a manifold connected to store the inkjet ink to supply to the set of ink channels.

The piezoelectric print-head is preferably a through-flow piezoelectric print-head. In a preferred embodiment the recirculation of the inkjet ink in a through-flow piezoelectric print-head flows between a set of ink channels and the inlet of the nozzle wherein the set of ink channels corresponds to the nozzle.

In a preferred embodiment in a piezoelectric print-head the minimum drop size of one single jetted droplet is from 0.1 pL to 100 nL, in a more preferred embodiment the minimum drop size is from 1 pL to 150 pL, in a most preferred embodiment the minimum drop size is from 1.5 pL to 15 pL. By using grayscale inkjet head technology multiple single droplets may form larger drop sizes. Minimum drop size of one single jetted droplet may be larger than 50 pL by a piezoelectric print-head, such as the Xaar™ 001 which is used in the digitalization of ceramics manufacturing processes.

In a preferred embodiment the piezoelectric print-head has a drop velocity from 3 meters per second to 15 meters per second, in a more preferred embodiment the drop velocity is from 5 meters per second to 10 meters per second, in a most preferred embodiment the drop velocity is from 6 meters per second to 8 meters per second.

In a preferred embodiment the piezoelectric print-head has a native print resolution from 25 DPI to 2400 DPI, in a more preferred embodiment the piezoelectric print-head has a native print resolution from 50 DPI to 2400 DPI and in a most preferred embodiment the piezoelectric print-head has a native print resolution from 150 DPI to 3600 DPI.

In a preferred embodiment with the piezoelectric print-head the jetting viscosity is from 5 mPa·s to 200 mPa·s more preferably from 25 mPa·s to 100 mPa·s and most preferably from 30 mPa·s to 70 mPa·s.

In a preferred embodiment with the piezoelectric print-head the jetting temperature is from 10° C. to 100° C. more preferably from 20° C. to 60° C. and most preferably from 30° C. to 50° C.

The nozzle spacing distance of the nozzle row in a piezoelectric print-head is preferably from 10 μm to 200 μm; more preferably from 10 μm to 85 μm; and most preferably from 10 μm to 45 μm.

Inkjet Ink

The inkjet ink in the present invention may be any type of ink which is jettable by a print-head. The inkjet ink may be a solvent inkjet ink, UV-curable inkjet ink or dye sublimation inkjet ink.

An inkjet ink may be a colourless inkjet ink and be used, for example, as a primer to improve adhesion or as a varnish to obtain the desired gloss. However, preferably the inkjet ink includes at least one colourant, more preferably a colour pigment.

The inkjet ink may be a cyan, magenta, yellow, black, red, green, blue, orange or a spot colour inkjet ink, preferable a corporate spot colour inkjet ink such as brown colour inkjet ink.

In a preferred embodiment the inkjet ink is an inkjet ink comprising metallic particles or comprising inorganic particles such as a white inkjet ink.

Curing Devices

By curing, the jetted liquid of the present invention is stabilized to the substrate. The stabilization of the jetted or printed liquid on the substrate ensures the placement of the droplet on the substrate.

In a preferred embodiment the jetted or printed liquid is cured on the substrate by actinic radiation, more preferably by infra-red radiation (IR) and most preferably by ultraviolet radiation. In a preferred embodiment the actinic radiation is near-infrared (NIR) or short-wavelength infrared (SWIR).

The curing device, such as a set of IR lamps, NIR lamps, SWIR, E-beam, UV bulb or UV LED lamps may travelling with the printing unit and/or be stationary attached as an elongated radiation source.

In a preferred embodiment the method comprises the method of controlling the time-to-cure to achieve less absorbance of a coloured liquid in the substrate so the colours are not faded. The time-to-cure determines the drop diameter and drop thickness. The time between impacting the liquid on the substrate and the curing, which is the time-to-cure, is preferably between 0.1 nanosecond and 1 second.

In a preferred embodiment the method comprises a method of controlling by enhancing the power of the curing device to stabilize the jetted liquid even more to make them more chemical resistant and mechanical resistant such as stretchability.

Any ultraviolet light source, as long as part of the emitted light can be absorbed by the photo-initiator or photo-initiator system in the liquid, for curing such liquids, may be employed as a radiation source, such as a high or low pressure mercury lamp, a cold cathode tube, a black light, an ultraviolet LED, an ultraviolet laser, and a flash light. Of these, the preferred source is one exhibiting a relatively long wavelength UV-contribution having a dominant wavelength of 300-400 nm. Specifically, a UV-A light source is preferred due to the reduced light scattering therewith resulting in more efficient interior curing.

UV radiation is generally classed as UV-A, UV-B, and UV-C as follows:

UV-A: 400 nm to 320 nm

UV-B: 320 nm to 290 nm

UV-C: 290 nm to 100 nm.

In a preferred embodiment, the curing device contains a set of UV LEDs with a wavelength larger than 360 nm, preferably one or more UV LEDs with a wavelength larger than 380 nm, and most preferably UV LEDs with a wavelength of about 395 nm. An advantage of using a set of UV LEDs as curing device is the fast changing of UV dose.

Furthermore, it is possible to cure the printed liquid using, consecutively or simultaneously, two light sources of differing wavelength or illuminance. For example, the first UV-source can be selected to be rich in UV-C, in particular in the range of 260 nm-200 nm. The second UV-source can then be rich in UV-A, e.g. a gallium-doped lamp, or a different lamp high in both UV-A and UV-B. The use of two UV-sources has been found to have advantages e.g. enabling a fast curing speed and a high curing degree.

For facilitating curing, the industrial inkjet system of the present invention may include one or more oxygen depletion units. The oxygen depletion units place a blanket of nitrogen or other relatively inert gas (e.g. $CO_2$), with adjustable position and adjustable inert gas concentration, in order to reduce the oxygen concentration in the curing environment. Residual oxygen levels are usually maintained as low as 200 ppm, but are generally in the range of 200 ppm to 1200 ppm.

Curing may be "partial" or "full". The terms "partial curing" and "full curing" refer to the degree of curing, i.e. the percentage of converted functional groups, and may be determined by, for example, RT-FTIR (Real-Time Fourier Transform Infra-Red Spectroscopy) which is a method well known to the one skilled in the art of curable formulations. Partial curing is defined as a degree of curing wherein at least 5%, preferably 10%, of the functional groups in the coated formulation or the fluid droplet is converted. Full curing is defined as a degree of curing wherein the increase in the percentage of converted functional groups with increased exposure to radiation (time and/or dose) is negligible. Full curing corresponds with a conversion percentage that is within 10%, preferably 5%, from the maximum conversion percentage. The maximum conversion percentage is typically determined by the horizontal asymptote in a graph representing the percentage conversion versus curing energy or curing time which is the time-to-cure.

To make the decoration layer more sustainable, robust, mechanical and/or chemical resistance, the curing step may be a plurality of curing passes instead of a single curing pass. For example a first curing pass to immobilize the printed liquid and a second curing pass to solidify the printed liquid.

Data-Streamer (200)

To render the decorative image of the present invention to a printing unit, the bitmap rows of the decorative image are transmitted row by row, as a stream of data, to a printing unit of an industrial inkjet system and to jet the bitmap rows on a substrate. The transmitting of the rows is performed by a data-streamer (200) which is included in the industrial inkjet system of the present invention. The advantage of data-streaming is the late possibility to change the image data of a decorative image before printing.

A bitmap row may contain tone-values for one colourant or more colourants from the colourant space of the industrial inkjet system.

The consecutive transmitted bitmap rows may be buffered for a limited number of bitmap rows, which is also called cache-based data-streaming. This buffer is a first-in-first-out buffer (FIFO)-buffer. The bitmap rows may be stored in very fast hard-disks, also called disk-based data-streaming but the disk throughput have than be equal or larger than the printing speed. Another way is to store the bitmap rows in memory, also called memoty based data-streaming. The buffer of limited number of bitmap rows in a cache-based data-streaming may be used to be able to follow the printing speed of the industrial inkjet system or may be used to do a small image manipulation, such as a halftoning method, on these limited number of bitmap rows. These small image manipulations have to be very fast so the buffer doesn't become empty while printing a decorative image. In a preferred embodiment the image manipulations are performed by a parallel processing method which is preferably resulted by calculations in one or more GPU's. The number of bitmap rows in such buffer is preferably limited up to 128 more preferably up to 256 and most preferably up to 1024. Due to the spatial resolution, tonal resolution and dimension of a transmitted bitmap row, the memory of this buffer may become very large. It is a challenge to have a fast data-streamer (200) with a fast accessible buffer that can follow a fast printing speed of the industrial inkjet system and the transmittance of the bitmap rows to a printing unit especially when the size of a bitmap row is large and comprises several bytes of image data.

For example the industrial inkjet system is an industrial single-pass inkjet system. The maximum printable width is 2.8 m and each print-head in the industrial inkjet system has a spatial resolution of 600 dpi. The maximum sized transmitted bitmap row of one colour has 66143 positions, also called pixels, wherein the tonal resolution of 1 pixel is 16 bit. If the number of bitmap rows in a buffer of the data-streamer (200) is 256 than the size of the buffer is minimal 33 mBytes.

When the resources of memory are low in a data-streamer (200), a bitmap row may be compressed with a lossy or lossless image compression method such as run-length encoding (RLE), adaptive dictionary algorithms as Lempel-Ziv compression, entropy encoding. By using image compression on a bitmap row, the transfer-speed can be enhanced and the number of bitmap rows stored in the data-streamer (200) can be enlarged. The compression and/or decompression of a bitmap row may be performed by one or more GPU's to make the inkjet method of the present invention faster. Decompression may be done in a step of data streaming but preferably be performed in the printing unit itself where to a compressed bitmap row is transmitted. Before jetting the compressed bitmap row is decompressed.

A data-streamer preferably comprises one or more optical fiber connection to enlarge the bandwidth for fast streaming of bitmap rows to a printing unit. The data-streamer is preferably comprised in a server box with quad or more core CPU's and one or more GPU's. For storing bitmap rows and other content the minimum memory is 32 GigaByte RAM and multiple Solid-state drives (SSD) with a minimum write and read speed of 250 MegaByte per second and more preferably with a minimum write and read speed of 600 MegaByte per second.

In the field of document printing fast data-streamers are available such as HP SmartStream Production Pro Print Server™ from Hewlett Packard™. But for the present invention these fast data-streamers for document printing have to be seriously adapted for the industrial inkjet system of the present invention especially when the printable width exceeds the 1 meter or printing speeds are above 50 meter per minute or the elongated decorative images are above 1 meter. For example Kyocera™ KJ4B-0300 print-head (www.global.kyocera.com) is able up to print 150 meter per minute in an industrial single-pass inkjet system. These data-streamers for document printing are optimized for document printing wherein text, symbols and characters are mainly printed but not for printing only decorative images as in the present invention.

If the industrial inkjet system comprises more than one printing unit, the data-streamer (200) may break down a transmitted bitmap row or an image manipulated bitmap row in a set of smaller bitmap rows wherein each smaller bitmap row is transmitted to a different printing unit of the industrial inkjet system.

The printing speed of the industrial inkjet system which also determines the transmittance speed of the data-streamer (200) is preferable between 35 meters per minute and 450 meters per minute and more preferable between 75 meters per minute and 250 meters per minute. A fast printing speed is an economical benefit in the printing of decoration layers and also in the manufacturing of decorative working pieces. The vertical and horizontal resolution of the industrial inkjet system, which also determines the power needs of the data-streamer is preferable between 300 dots-per-inch and 2400 dots-per-inch and more preferable between 600 dots-per-inch and 1800 dots-per-inch. Larger these resolutions, the larger the calculation power and data transmittance speed of the data-streamer.

In the present invention a data-streamer (200) performs the following steps of the present invention: skipping at least one bitmap row of the decorative image and/or printing two consecutive transmitted bitmap rows with a row print distance smaller than a nominal row print distance (400) upon dimensional expansion; or reprinting at least one bitmap row on the substrate and/or printing two consecutive transmitted bitmap rows with a row print distance larger than the nominal row print distance (400) upon dimensional shrink.

In a preferred embodiment a data-streamer (200) for an inkjet printing method of decorative images may comprise a halftone management system (210) to halftone a bitmap row to a halftoned bitmap row before or preferable while transmitting the bitmap row to a printing unit of an industrial inkjet system. The halftoning method in this preferred embodiment is preferably a dithering method and more preferably an amplitude modulated halftoning method or a frequency modulated halftoning method. More detail about dithering methods is disclosed in ULICHNEY, ROBERT. Digital Halftoning. Edited by THE MIT PRESS. USA: Massachusetts Institute of Technology, 1987. ISBN 0262210096. The advantage of a data-streamer (200) comprising such a halftone management system (210) is the late possibility to change to another halftoning method which guarantees a faster setup for the manufacturing of decorative working pieces. In a more preferred embodiment, when the industrial inkjet system is capable of printing, next to a set of base colourants, such as CMYK, also light colours, such as light cyan and light magenta, the halftoning method may contain a ink splitting method to split tone-values of a bitmap row in to a bitmap row comprising tone-values of a base colourant and a light variant of the base colourant.

In another preferred embodiment a data-streamer (200) for an inkjet printing method of decorative images may comprise a tone value map system to convert tone-values of a bitmap row based on a tone-value map before or preferably while transmitting the bitmap row to a printing unit. The advantage of a data-streamer (200) comprising a tone value map system is the late possibility to change the tone values of bitmap rows before or preferably while transmitting them to a printing unit such as:

changing contrast and/or brightness in printed decorative images while printing a copy of the decorative image; or changing hue and/or saturation in printed decorative images while printing a copy of the decorative image; or adapting a gamma curve of a colourant channel in printed decorative images while printing a copy of the decorative image;

changing a linearization curve of a colourant channel in printed decorative images while printing a copy of the decorative image; or converting a decorative image, defined in a colourant space or colour space to the colourant space of the industrial inkjet system; or compensating density variances due to priming, coating or impregnating with a liquid based on a measurement of density variances, for example by a digital camera, spectrophotometer, or densitometer, after primer, coating or impregnating. The products out the PVA-JET-S-family of INTRO™ International GmbH can be used for this preferred embodiment. Products in this family comprise cameras which are able to capture parts of printed decorative images and/or control-strips at printing speeds up to 300 m/min.

In a preferred embodiment a data-streamer (200) for an inkjet printing method of decorative images may comprise a nozzle tone value correction system to convert a tone value of a position in a transmitted bitmap row to compensate ink volume differences, also called density variances, between nozzles of a print-head in the printing unit and/or ink volume differences between a set of print-heads in a printing unit. It is found that an ink volume may differ from nozzle to nozzle in a print-head or in a printing unit. In most print-heads or printing units there is no method to calibrate the ink volume per nozzle. This results in density differences, viewed as dark or light bands, which are in decorative workpieces very annoying due to the fact that several decorative workpieces, such as laminates, may be combined to one piece, such as a floor. The density differences are not pleasant for the eye and should be avoided. For example to compensate a too large ink volume for a nozzle the tone-value of a position in a bitmap row, which corresponds to the nozzle, shall be lowered by the data-streamer (200) to a tone-value that corresponds to a determined ink volume. Or vice-versa, to compensate a too small ink volume for a nozzle the tone-value of a position in a bitmap row, which corresponds to the nozzle, shall be enlarged by the data-streamer (200) to a tone-value that corresponds to a determined ink volume. By measuring the ink-volume per nozzle, for example by measuring densities of printed patches or weighing ink-volume per nozzle, a look-up-table can be determined wherein the compensations of ink volume differences can be calculated. The products out the PVA-JET-S-family of INTRO™ International GmbH can be used for this preferred embodiment. Products in this family comprise cameras which are able to capture parts of printed decorative images and/or control-strips at printing speeds up to 300 m/min.

In a preferred embodiment a data-streamer (200) for an inkjet printing method of decorative images may comprise a bitmap row multiplexer to multiplex bitmap rows of two or more decorative images to jet the bitmap rows in one row by the printing unit so parts of multiple decorative images are printed next to each other in the same printing pass. The advantage is that the multiple decorative images can be printed simultaneously and late imposition of multiple decorative images becomes easily available which encourage the advantages of manufacturing-on-demand. The printing of multiple decorative images embodiment may give advantage in less substrate waste when the decorative images are imposed to minimize the waste, also called nesting. The multiplexing of bitmap rows is preferably done before transmitting to the printing unit but more preferably while transmitting to the printing unit.

In another preferred embodiment a data-streamer (200) for an inkjet printing method of decorative images, performed by an industrial single-pass inkjet system may comprise a nozzle failure devisualizing system to manipulate tone values in a bitmap rows to devisualize a nozzle failure in a printing unit before or preferably while transmitting the bitmap row to the printing unit. If a nozzle from a print-head or printing unit fails to jet, a single "empty" line in industrial single-pass inkjet systems becomes visible. To avoid waste of substrate, the tone-value in a position of the bitmap row that corresponds to a neighbour nozzle of the failed nozzle, may be enlarged to devisualize this single "empty" line. The industrial inkjet system may have an image capturing device to detect failing nozzles in decoration layers so the data-streamer (200) gets input which nozzle of a printing unit from the industrial inkjet system fails. The products out the PVA-JET-S-family of INTRO™ International GmbH (www.intro-int.de) can be used for this preferred embodiment. Products in this family comprise cameras which are able to capture parts of printed decorative images and/or control-strips at printing speeds up to 300 m/min.

To control the process of manufacturing decorative workpieces a control strip may be printed near the printed decorative images. A data-streamer (200) for an inkjet printing method of decorative images may comprise a control strip generator which generates a control strip and may multiplex the control strip row by row together with a bitmap rows of a decorative image before or more preferably while transmitting to a printing unit. A bitmap row of the control strip and a bitmap row of the decorative image are than multiplexed to one bitmap row before or while sending them to the printing unit.

The control strip may comprise:

content of a value from a parameter of the industrial inkjet system; and/or content of information of a decorative image; and/or content of track-and-trace information; and/or patches or register marks for calibrating and controlling the calibration of an industrial inkjet system; and/or register marks to identify dimensional changes in a substrate.

The content of a value from a parameter may be embedded in any representation form: such as one dimensional bar codes or QR-codes or just in text form.

Such control strips are an advantage for the quality control of the printed decorative images, especially in manufacturing of decorative workpieces.

The industrial inkjet system may have an image capturing device or measuring device such as a spectrophotometer, to detect and/or to measure a patch of a printed control strip. Preferably the transmitted bitmap row of the control strip is uncompressed or more preferably compressed with a lossless image compression method, else with a lossy image compression method, fine-art in a control-strip, especially for calibrations, may be disturbed by annoying lossy compression artefacts.

A data-streamer (200) of an inkjet printing method of decorative images may comprise a print-head maintenance system by manipulating bitmap rows by adding to the tone values of a bitmap row extra pseudo-randomized data so a print-head of a printing unit is spitting while a decorative image is jetted without any lost of print quality. To prevent curing and/or drying of inkjet ink in het nozzle or at the outside of the nozzle, it is advantageous to spit a small droplet of inkjet ink, also called a spit-droplet, while a nozzle is unused for a long time. To prevent that the spitted droplets influence the print quality such as colour variances, the amount of ink comprised in a spit-droplet is preferably small, such as smaller than 12 pL and/or the number of spit-droplets is preferably small, such as smaller than 10 spit-droplets per 10 cm of a bitmap row, so it is not viewable by the naked eye on the decoration layer or a manufactured decorative workpiece. This preferred method of spitting may take care that each nozzle of each printing unit in the industrial inkjet system is spitting minimum one droplet after 30 minutes of inactivity in the nozzle, more preferably minimum one droplet after 15 minutes of inactivity in the nozzle. In a decorative image the total coverage per pixel is mostly more than zero so spitting while printing shall not affect the print quality. Also the pseudo-randomizing, such as blue noise masking, makes the spitting of ink invisible for the naked eye on a decoration layer due to its random pattern.

The drying and/or curing of inkjet ink at the nozzle results in clogged nozzles and nozzle failure, so at regular intervals the nozzles have to be maintained. A known maintenance method for an industrial inkjet system is spitting in a maintenance unit. An example of such maintenance method is disclosed in U.S. Pat. No. 8,360,549 (SAMSUNG ELECTRONICS). In the previous described preferred embodiment, the data-streamer (200) spits while printing the decorative imave without loosing any print quality. This is a tremendous advantage for the printing of a decoration layer and also in the manufacturing of decorative workpieces because the maintenance of the nozzle is done while printing which shortens the time of printing decoration layers and thus also shortens the time of manufacturing of decorative workpieces.

Graphic Processing Units

Graphic Processing Units (GPU's) have been used to render computer graphics for years. Nowadays they are also used for general-purpose tasks due to their highly parallel structure, making them more efficient than Central Processing Units (CPU's).

GPU's can be combined with CPU's to achieve greater performance. In this way, serial parts of the code would run on the CPU and parallel parts would do it on the GPU. While CPU's with multiple cores are available for every new computer and allow the use of parallel computing, these are focused on having a few high performance cores. On the other hand, GPU's have an architecture consisting of thousands of lower performance cores, making them especially useful when large amount of data have to be processed.

One of the most popular tools available on the market of GPU computing is CUDA. CUDA is a parallel computing platform and programming model created by Nvidia™ and available only for their GPU's. The main advantage of CUDA is its ease of use, using the language known as CUDA C which is essentially an extension of C, with similar syntax and very easy to integrate in a C/C++ environment.

The CUDA processing flow is as follows: The needed data is first copied from the main memory to the GPU memory, the CPU sends an instruction to the GPU, the GPU executes the instruction in all the parallel cores at the same time, and the result is copied back from the GPU memory to the main memory.

CUDA parallel execution units consist of threads grouped into blocks. Combining the use of blocks and threads the maximum number of available parallel units can be launched, which for the latest GPU's can be more than 50 million. Even though this is a great amount of parallel capability, there are some cases where data might exceed the limit. In those cases, the only possibility is to iterate through the grid of millions of parallel units as many times as needed till all the data is processed.

Dimensional Measurement

In a preferred embodiment measuring dimensional changes in a substrate may be done on a printed copy of a decorative image or on a printed control strip on the substrate. The dimensions of a decorative image are known before printing so these dimensions can be compared with an image captured printed decorative image so the compensation can be calculated. Another way to measure dimensional changes in a substrate is measuring in a printed control strip next to the printed copies of the decorative image determined distances between marks in the printed control-strip by an optical sensor or by image capturing. By comparing the determined distances with the measured distances, the compensation can be calculated. A Mightex™ CCD Line Camera may be used to measure such dimensional changes in a substrate for example on the edges between printed copies of the decorative image or on small lines with a determined distance in a control strip.

In a preferred embodiment the method of measuring dimensional changes in a substrate comprises an image recognition method, for example to detect edges on a printed decorative image or detect marks in a control-strip.

Other Embodiments

Another embodiment is an industrial inkjet system that comprises a data-streamer (200) to perform the inkjet printing method of the present invention or a data-streamer (200) that performs the inkjet printing method of the present invention.

Another embodiment is a manufacturing method of decorative workpieces that comprises the inkjet printing method of the present invention or a decorative workpiece that is manufactured by comprising step: the inkjet printing method of the present invention.

The result from the inkjet printing method of the present invention is a decoration layer comprising printed bitmap rows of a decorative image wherein:

$D_y$ is a distance between a printed bitmap row and another print bitmap row wherein the printed bitmap row and the another printed bitmap row has the same colour; and N is number of printed bitmap rows, between the printed bitmap row and the another printed bitmap row; and $R_x$ is a print pitch of the printed bitmap rows; and averaged bitmap row print distance $R_y$ is defined by formula (I):

$$R_y = \frac{D_y}{N+1} \quad \text{Math. 2}$$

factor ρ is defined by formula (II):

$$\rho = \left(\frac{\mathrm{MIN}(R_x, R_y)}{\mathrm{MAX}(R_x, R_y)}\right) \times \left|\frac{\mathrm{MAX}(R_x, R_y)}{\mathrm{MIN}(R_x, R_y)} - N\mathrm{INT}\left(\frac{\mathrm{MAX}(R_x, R_y)}{\mathrm{MIN}(R_x, R_y)}\right)\right| \quad \text{Math. 3}$$

wherein the decoration layer is characterized by $$0.005 \leq \rho \leq 0.040 \quad \text{Math. 4}$$

and $$D_y \geq 100 \text{ mm} \quad \text{Math. 5}$$

Figure 5:
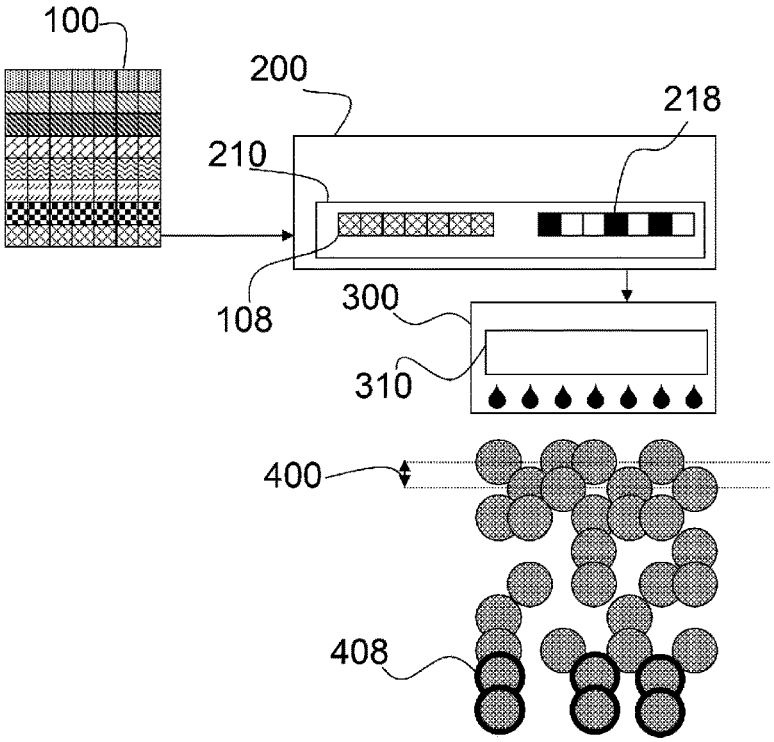
FIG. 5 illustrates a preferred embodiment of the present invention wherein the $8^{th}$ bitmap row (108) of decorative image (100) is manipulated in the data-streamer (200) to print the bitmap row on a substrate, which is not visible in this figure. The data-streamer (200) performs a halftoning method by halftone management system (210) to achieve a halftoned bitmap row (218) which is transmitted to a printing unit (300) with a printhead (310) to print the halftoned bitmap row (218) on the substrate after previous printed bitmap rows with a nominal row print distance (400). To compensate dimensional shrinkage in the substrate the halftoned bitmap row (218) is printed twice (408).
Figure 6:
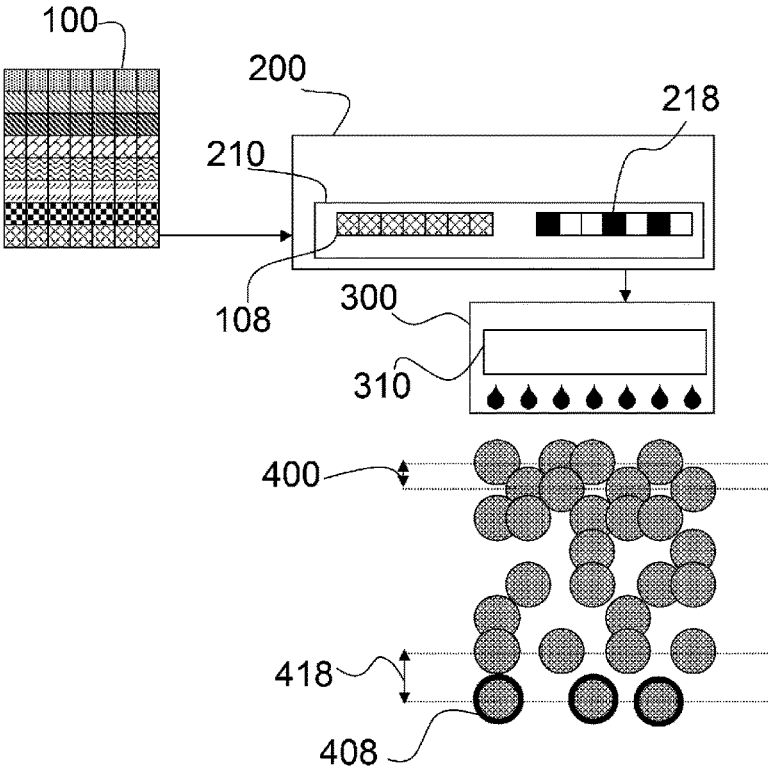
FIG. 6 illustrates a preferred embodiment of the present invention wherein the $8^{th}$ bitmap row (108) of decorative image (100) is manipulated in the data-streamer (200) to print the bitmap row on a substrate, which is not visible in this figure. The data-streamer (200) performs a halftoning method by halftone management system (210) to achieve a halftoned bitmap row (218) which is transmitted to a printing unit (300) with a printhead (310) to print the halftoned bitmap row (218) on the substrate after previous printed bitmap rows with a nominal row print distance (400). To compensate dimensional shrinkage in the substrate the halftoned bitmap row (218) is printed (418) with a larger row print distance (418) than the nominal row print distance (400).

In prior-art decoration layers, printed with traditional printing methods or digital printing methods, such profiles are stable around the nominal bitmap row distance and didn't comprise variances between row print distances of consecutive printed bitmap rows. NINT( ) a function in the formula (I) represents the nearest integer function (en.wikipedia.org/wiki/Nearest_integer_function). It is clear from the presented invention that the printed bitmap rows; between the printed bitmap row and the another printed bitmap row which defines N as number of printed bitmap rows are all of the same color as the printed bitmap row and the another printed bitmap row (FIG. 5, FIG. 6)

Analogue as bitmap row print distance, there is also a bitmap column print distance, also called print pitch of a printed bitmap row.

In a preferred embodiment $D_y$ is equal to 100 mm or in more preferred embodiment $D_y$ is equal to 200 mm.

Bitmap row distances and consecutive bitmap row distance profiles can be measured by a scanning electron microscope (SEM), such as a Tescan™ SEM or a Sirion™ SEM. Another measurement device is an optical profiler, such as the Wyko NT3300. By means of a multi-region-analysis it is possible to segment the dots and perform a statistical dimension analysis to calculate drop diameter and thickness of printed or jetted drops and to calculate bitmap row distances of consecutive printed bitmap rows of a decorative image on a substrate. Bitmap row distances may also be measured with image quality analysis products such as QEA™ IAS®-1000 software of QEA™ together with the ADF (Automatic Document Feeder) of QEA™ (www.qea-.com) or the scanner systems or full motion systems of KDY™ (www.kdy.com) with its ImageXpert™ software. A Peak™ #1972 Glass Scale with Magnifier with double loupe is also a tool to measure bitmap row distances.

To calculate and measure the distance between a printed bitmap row and another print bitmap row, the distance between the axis of symmetry from the printed bitmap row and the axis of symmetry from the another print bitmap row is measured. An axis of symmetry of a printed bitmap row is parallel with the printed bitmap row.

To calculate and measure a print pitch of a printed bitmap row, the distances between two neighbour printed pixels of the printed bitmap row is measured by measuring the distance on the axis of symmetry of the printed bitmap row between the centres of the two neighbouring printed pixels.

In another preferred embodiment a consecutive row print distance profile from a plurality of printed bitmap rows in the same colour comprises a row print distance jump. A consecutive row print distance profile from a plurality of bitmap rows is a profile that represents the row print distances between a bitmap row and the consecutive bitmap row. In prior-art decoration layers, printed with traditional printing methods or digital printing methods, such profiles are stable around the nominal bitmap row distance and didn't comprise a row print distance jump in their consecutive row print distance profiles. A row print distance jump in a consecutive row print distance profile is a suddenly change (=jump) in the row print distance of consecutive bitmap rows. In statistics and signal processing, step detection (also known as step smoothing, step filtering, shift detection, jump detection or edge detection) is the process of finding abrupt changes (steps, jumps, shifts) in the mean level of a time series or signal or profile. It is usually considered as a special case of the statistical method known as change detection or change point detection.

Especially when the bitmap rows are printed by an inkjet printing method it is easy to calculate all these distances, print pitches and profiles because the printed drops on the decorative layer can easily be determined by optical profilers. Another good tool to determine theses distances, print pitches and profiles is an IAS™ instrument of QEA™ (www.qea.com) which apply the ISO-13660 international standard in quantifying print quality attributes. QEA has handheld products such as PIAS-II; camera-based products such as IAS-1000L or IAS-1000AS and scanner-based products such as IAS-2000D In a preferred embodiment the decorative image on the decoration layer is a wood pattern wherein wood grains of the wood pattern are oriented perpendicular to plurality of printed bitmap rows.

In another preferred embodiment the decoration layer is impregnated with a thermosetting resin and more preferably the thermosetting is or comprises a melamine-formaldehyde based resin, ureum-formaldehyde based resin and/or a phenol-formaldehyde based resin.

REFERENCE SIGNS LIST

11 Paper manufacturer
12 Paper roll
13 Decor printer
14 Gravure printing
15 Inkjet printing
16 Decor Paper roll
17 Warehouse
18 Impregnation
19 Cutting to size
20 Floor laminate manufacturer
21 Floor laminate
22 Printing ink acceptance layer
30 Decorative panel
31 Core layer
32 Groove
33 Tongue
34 Decorative layer
35 Protective layer
36 Balancing layer
100 Decorative image
108 Bitmap row
200 Data-streamer
210 Halftone management system
218 Halftoned bitmap row
300 Printing unit
310 Print-head
400 Nominal row print distance
408 Printed halftoned bitmap row
418 Row print distance

The invention claimed is:

1. A single pass inkjet printing method for forming a decoration layer, the method comprising the steps of:

printing copies of a decorative image with a printing unit on a web-shaped substrate by transmitting consecutive bitmap rows of the decorative image to the printing unit;

measuring dimensional changes in the web-shaped substrate while printing the copies of the decorative image; and compensating for the dimensional changes while printing the copies of the decorative image by:

reprinting at least one of the bitmap rows of the decorative image on the web-shaped substrate.

2. The method according to claim 1, wherein the dimensional changes are measured in a printed copy of the decorative image or in a printed control strip on the web-shaped substrate.

3. The method according to claim 2, further comprising the steps of:

image analyzing at least one of the bitmap rows of the decorative image and determining if the at least one of the bitmap rows is reprintable; and selecting at least one of the bitmap rows of the decorative image to compensate for the dimensional changes depending on a determination whether the at least one of the bitmap rows is reprintable.

4. The method according to claim 3, wherein the dimensional changes are measured after the printing step and after:

drying the web-shaped substrate with a dryer;

cutting the web-shaped substrate with a cutter;

priming the web-shaped substrate with a liquid; or impregnating the web-shaped substrate with a liquid.

5. The method according to claim 4, wherein the web-shaped substrate is a paper substrate and the dimensional changes are measured after impregnating the paper substrate with a thermosetting resin.

6. The method according to claim 5, wherein the thermosetting resin includes a melamine-formaldehyde based resin, ureum-formaldehyde based resin, and/or phenol-formaldehyde based resin.

7. The method according to claim 6, wherein the decorative image represents a wood pattern, and wood grains in the wood pattern are oriented perpendicular or substantially perpendicular to the bitmap rows of the decorative image.

8. The method according to claim 7, wherein a nominal row print distance between two consecutive transmitted bitmap rows is less than 45 μm.

9. The method according to claim 8, wherein the printing of the copies of the decorative image is performed at a speed between 35 m/min and 450 m/min with a horizontal and vertical resolution between 300 dots-per-inch and 2400 dots-per-inch.

10. The method according to claim 3, further comprising step of:

halftoning consecutive transmitted bitmap rows while printing; wherein the halftoning includes dithering or an amplitude modulated halftoning method or a frequency modulated halftoning method.

11. The method according to claim 10, further comprising, prior to the halftoning step, the step of:

compensating for ink volume differences between nozzles of the printing unit for the consecutive transmitted bitmap rows.

* * * * *